US008276343B2

(12) United States Patent
Yang

(10) Patent No.: US 8,276,343 B2
(45) Date of Patent: Oct. 2, 2012

(54) MODULAR FLOOR

(76) Inventor: Feng-Ling Yang, Taichung (TW)

( * ) Notice: Subject to any disclaimer, the term of this patent is extended or adjusted under 35 U.S.C. 154(b) by 0 days.

(21) Appl. No.: 12/606,337

(22) Filed: Oct. 27, 2009

(65) Prior Publication Data

US 2011/0016815 A1 Jan. 27, 2011

(30) Foreign Application Priority Data

Jul. 22, 2009 (TW) ..... 98213449 U

(51) Int. Cl.
*E04B 2/00* (2006.01)

(52) U.S. Cl. ..... 52/584.1; 52/509; 52/582.1; 52/591.5

(58) Field of Classification Search ..... 52/578, 52/582.1, 591.4, 591.5, 592.1, 509, 506.05, 52/584.1

See application file for complete search history.

(56) References Cited

U.S. PATENT DOCUMENTS 2,433,749 A * 12/1947 Field, Jr. ..... 236/45
5,253,464 A * 10/1993 Nilsen ..... 52/508
6,233,386 B1 * 5/2001 Paek et al. ..... 385/123
6,550,206 B2 * 4/2003 Lee ..... 52/480
7,171,790 B2 * 2/2007 Mei ..... 52/584.1
7,243,470 B2 * 7/2007 Chae ..... 52/480
7,386,963 B2 * 6/2008 Pervan ..... 52/589.1
7,624,554 B2 * 12/2009 Chae ..... 52/480
7,805,903 B2 * 10/2010 Liu ..... 52/489.1

FOREIGN PATENT DOCUMENTS

GB 2433749 A * 7/2007
TW M 271046 7/2005

* cited by examiner

*Primary Examiner* — Brian Glessner
*Assistant Examiner* — Adam Barlow
(74) *Attorney, Agent, or Firm* — Browdy and Neimark, PLLC

(57) ABSTRACT

A modular floor is composed of a plurality of floor panels and combination members. Each of the floor panels includes a rectangular main body, a ridge formed at one side of the main body, an outer socket formed at an opposite side of the main body relative to the ridge, a first lateral bottom portion formed below the ridge, and a second lateral bottom portion formed below the outer socket. Each of the combination members includes a base, a front retainer protruding upward from one side of a top side of the base, a rear retainer protruding upward from an opposite side of the top side of the main body relative to the front retainer, and a partition protruding upward from a midsection of the top side of the base.

2 Claims, 5 Drawing Sheets

MODULAR FLOOR

BACKGROUND OF THE INVENTION

1. Field of the Invention

The present invention relates generally to building materials, and more particularly, to a modular floor.

2. Description of the Related Art

Most of conventional modular floors each are composed of a plurality of rectangular floor panels combined with one another. As shown in FIG. 4, a typical modular floor 70 as disclosed in Taiwan Patent No. M271046 is composed of a plurality of floor panels 71 and a plurality of combination members 72. Each of the floor panels 71 includes a first combination portion 73 and a second combination portion 74. One of the floor panels 71 is combined with the adjacent floor panel 71 by a plurality of screws 75 and some of the combination members 72, each of which has one end engaged with the second combination portion 74 and the other end thereof engaged with the first combination portion 73.

However, while the modular floor 70 is installed, it may easily happen that the combination member 72 is not well engaged with the first combination portion 73, such that the adjacent sides of the adjacent floor panels 71 are less supported, as shown in FIG. 5, to likely subside after the modular floor 70 is installed completely. When a user stands on it, the user may feel uncomfortable. Besides, dusts or dirt may be accumulated in the modular floor 70. In addition, the floor panel 71 is combined with the combination member 72 by the screws 75, such that there is none of any gaps between the adjacent floor panels 71 after they are combined with each other, i.e. the floor panels 71 are tightly combined. For this reason, there is no space for deformation resulted from thermal expansion and cool contraction and then the modular floor 71 is subject to partial protrusions after a period of time, such that the user may feel very inconvenient while walking on it.

SUMMARY OF THE INVENTION

The primary objective of the present invention is to provide a modular floor, which can avoid subsidence resulted from defective combination and avoid roughness incurred by thermal expansion and cool contraction.

The foregoing objective of the present invention is attained by the modular floor composed of a plurality of floor panels and a plurality of combination members. Each of the floor panels includes a rectangular main body having two long sides and two short sides; a ridge formed at one of the long sides of the main body and extending between two distal ends of the long side of the main body and along the long side in parallel; an outer socket formed at the other long side of the main body and extending between two distal ends of the long side of the main body and along the long side in parallel; a first lateral bottom portion formed below the ridge from the main body; and a second lateral bottom portion formed below the outer socket from the main body. Each of the combination members includes a base, a front retainer protruding upward from one side of a top side of the base, a rear retainer protruding upward from an opposite side of the base relative to the front retainer, and a partition protruding upward from a midsection of the top side of the base for more stable combination between the adjacent floor panels.

DETAILED DESCRIPTION OF PREFERRED EMBODIMENTS

Figure 1:
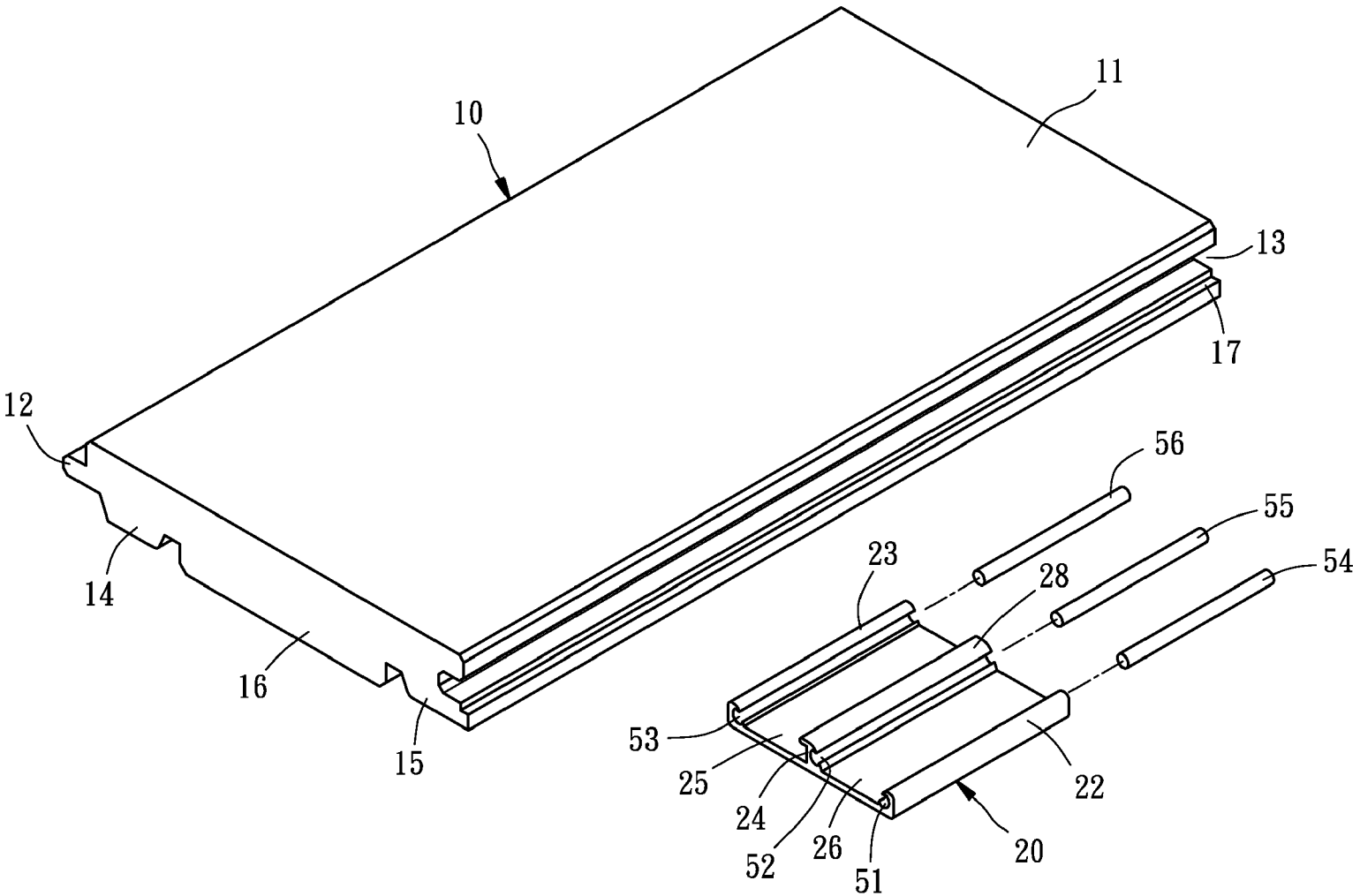
FIG. 1 is an exploded view of a preferred embodiment of the present invention.
Figure 2A:
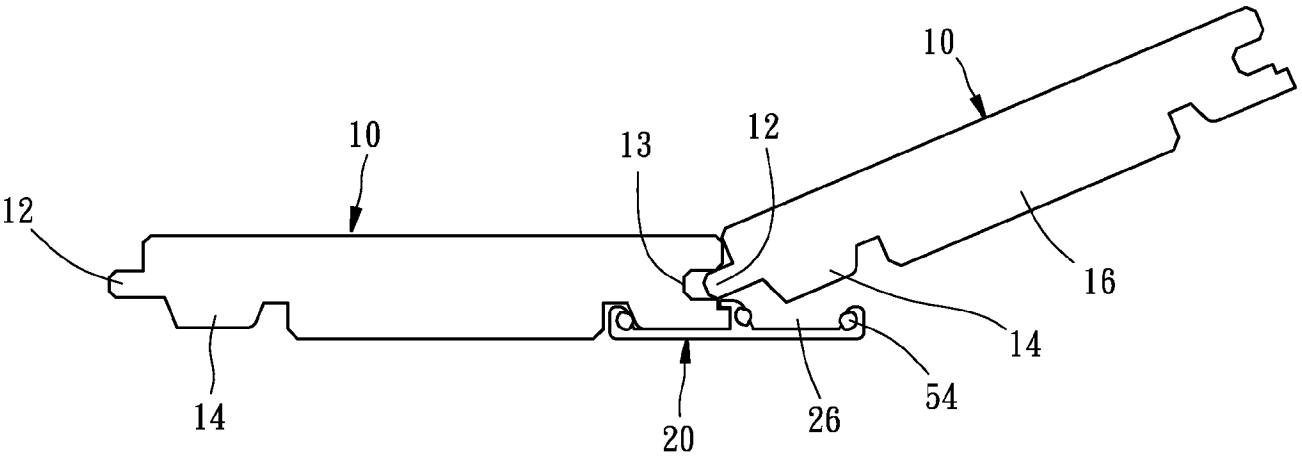
FIG. 2A is a side view of the preferred embodiment of the present invention in assembly.
Figure 2B:
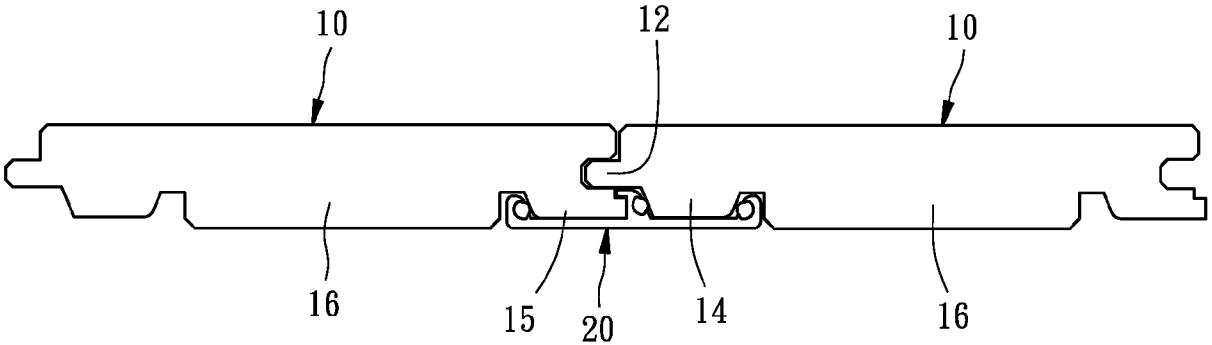
FIG. 2B is another side view of the preferred embodiment of the present invention in assembly.
Figure 3:
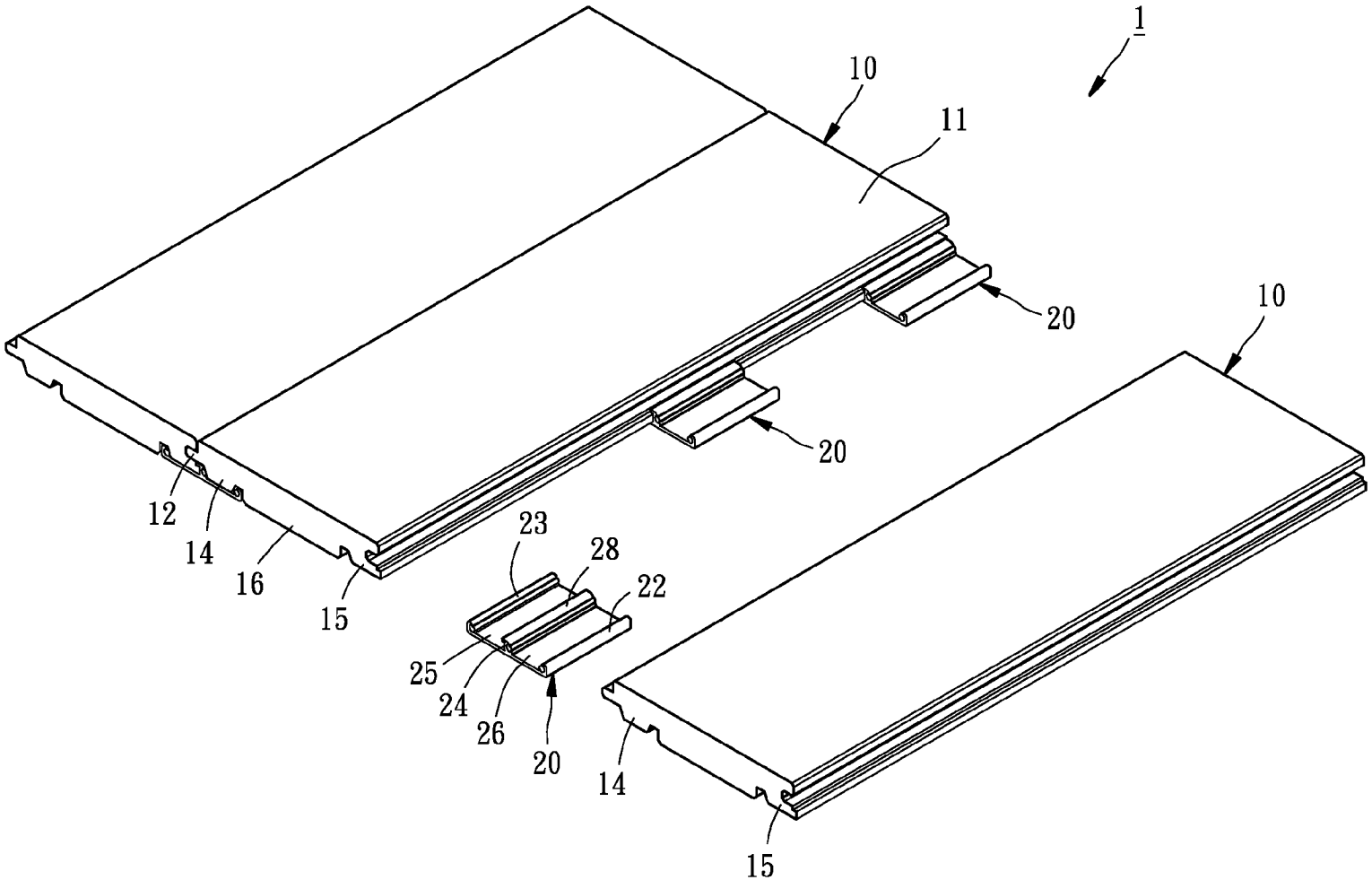
FIG. 3 is a perspective view of the preferred embodiment of the present invention in assembly.
Figure 4:
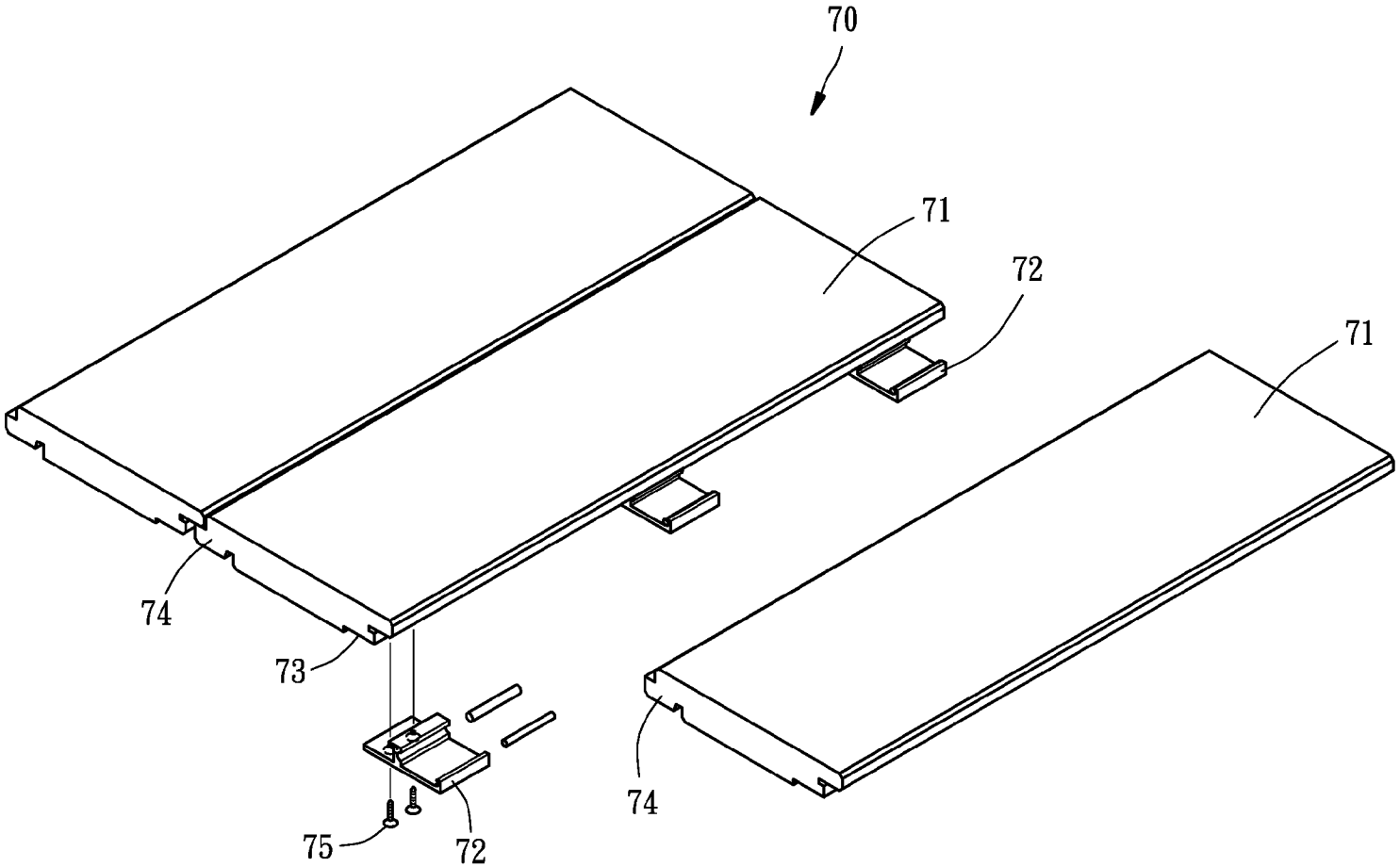
FIG. 4 PRIOR ART
FIG. 4 is a perspective view of a conventional modular floor in assembly.
Figure 5:
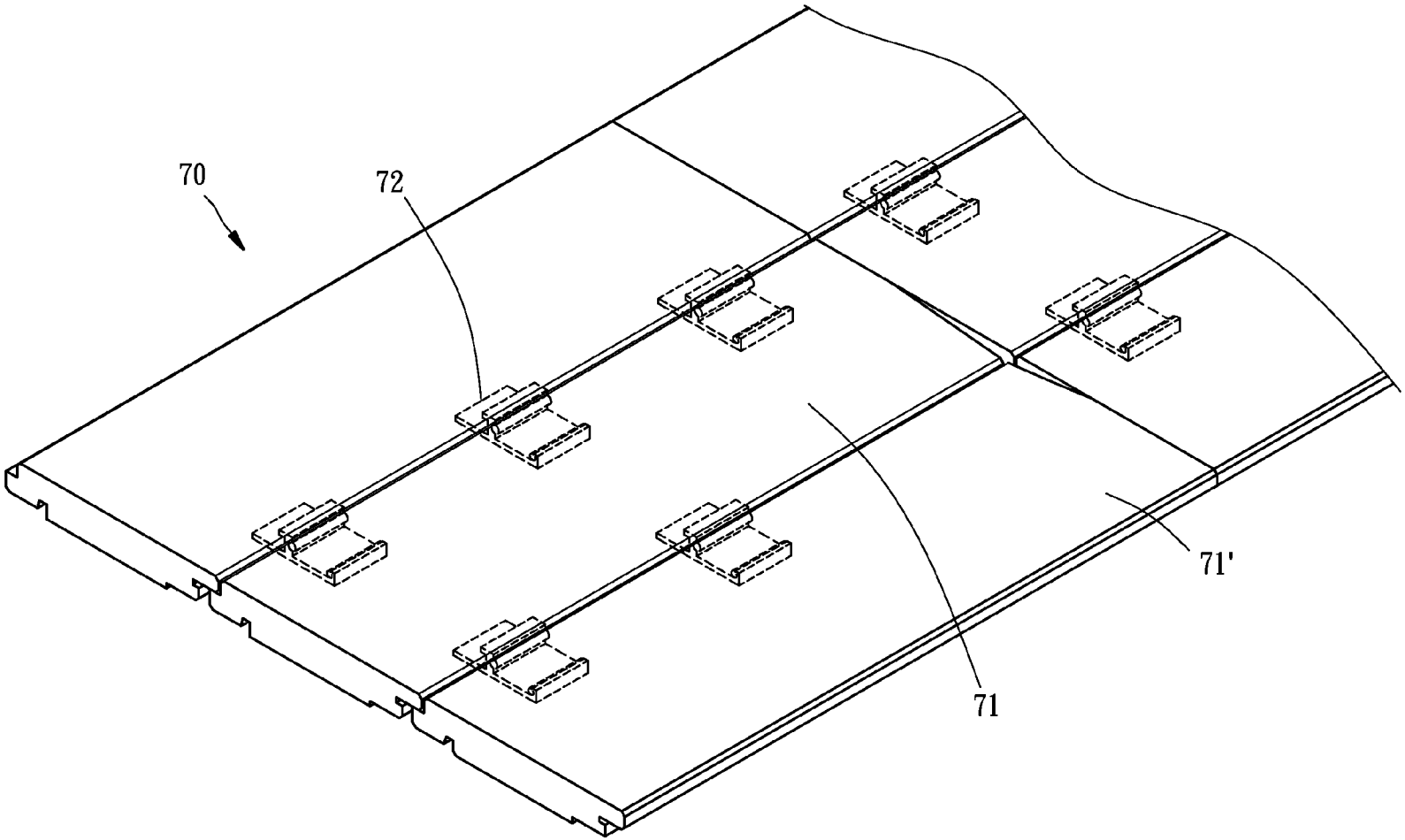
FIG. 5 PRIOR ART
FIG. 5 is a perspective view of the conventional modular becoming deformed.

Referring to FIGS. 1-3, a modular floor 1 constructed according to a preferred embodiment of the present invention is composed of a plurality of floor panels 10 and a plurality of combination members 20.

Each of the floor panes 10 includes a rectangular main body 11, a ridge 12, an outer socket 13, a first lateral bottom portion 14, a second lateral bottom portion 15, a central bottom portion 16, and a stepped portion 17. The rectangular main body has two long sides and two short sides. The ridge 12 is formed at one of the long sides of the main body 11, extending along the long side in parallel between two distal ends of the long side. The outer socket 13 is formed at the other long side of the main body 11, extending along the long side in parallel between two distal ends of the long side. The first lateral bottom portion 14 is located below the ridge 12. The second lateral bottom portion 15 is located below the outer socket 13. The stepped portion 17 is formed at an external upper side of the second lateral bottom portion 15, extending parallel along the outer socket 13. The central bottom portion 16 is located at a bottom side of the floor panel 10 and between the first and second lateral bottom portions 14 and 15. When two of the floor panels 10 are combined with each other, the ridge 12 of one of the floor panels 10 is inserted into the outer socket of the other floor panel 10 for preventing the modular floor 1 from deformation resulted from humidity or pressure.

Each of the combination members 20 includes a base 21, a front retainer 22 protruding upward from one side of a top side of the base 21, a rear retainer 23 protruding upward from an opposite of the top side of the base 21 relative to the front retainer 22, and a partition 24 protruding upward from a midsection of the top side of the base 21. A fastening piece 28 is formed at a top side of each of the partitions 24, bending toward the rear retainer 23. A first receiving portion 26 is formed between the front retainer 22 and the partition 24. A second receiving portion 25 is formed between the rear retainer 23 and the partition 24. The first receiving portion 26 is provided for receiving the first lateral bottom portion 14. The second receiving portion 25 is provided for receiving the second lateral bottom portion 15. Each of the front retainers 22 has a first inner socket 51 formed at an inner side thereof and facing one side of the partition 24. A first springy member 54 is mounted to the first inner socket 51. The partition 24 has a second inner socket 52 formed at an inner side thereof and facing one side of the front retainer 22. A second springy member 55 is mounted to the second inner socket 52. The rear retainer 23 has a third inner socket 53 formed at an inner side thereof and facing the other side of the partition 24 opposite to the first inner socket 51. A third springy member 56 is mounted to the third inner socket 53.

Referring to FIGS. 2A, 2B & 3, the modular floor 1 of the present invention can be combined according to but not limited to the following operation. During the combination of the modular floor 1, some of the combination members 20 are mounted to the second bottom portion 15 of the adjacent floor panels 10 in a predetermined interval and the fastening pieces 28 are engaged with the stepped portions 17 of the adjacent floor panels 10. The rear retainers 23, the partitions 24, and the fastening pieces 28 jointly hold the second bottom portions 15 in the second receiving portions 25. The third springy members 56 in the third inner sockets 53 force the second lateral bottom portion 15 to tightly lean against the partitions 24 in such a way that the second lateral bottom portion 15 is engaged with the second receiving portions 25 tight. As shown in FIG. 2A, the ridge 12 of the adjacent floor panel 10 is inserted slantwise into the outer socket 13 of the floor panel 10. Next, as shown in FIG. 2B, the first lateral bottom portion 14 of the floor panel 10 is engaged with the outer socket 13 by the ridge 12 then to slide into the first receiving portions 26; meanwhile, the front retainers 22 lean against the central bottom portion 16 of the floor panel 10 tight. The first and second springy members 55 can be filled in gaps between the first retainers 14 and the first receiving portions 26 to enable tight connection therebetween. After the combination is done, a gap is reserved between the ridge 12 and the outer socket 13 and between adjacent upper lateral sides of the adjacent floor panels 10 so as to prevent the modular floor 1 from the roughness incurred by thermal expansion and cool contraction.

In light of the above the structure, the ridge 12 and the outer socket 13 are engaged with each other to provide a supporting force for the whole modular floor 1, such that no deformation will happen due to any pressure or any improper installment of the combination members 20. Besides, even if the combination members 20 are not installed properly, the adjacent sides of the floor panels 10 will not subside. Furthermore, the first and second receiving portions 26 and 25 hold the first and second retainers 14 and 15 very tight to enable tight combination of the floor panels 10 by means of the combination members 20. Because the partitions 24 can have the adjacent floor panels 10 form gaps therebetween, the complete modular floor 1 will be not deformed due to the thermal expansion and cool contraction. In conclusion, the present invention can avoid deformation and improper assembly.

Although the present invention has been described with respect to a specific preferred embodiment thereof, it is in no way limited to the specifics of the illustrated structures but changes and modifications may be made within the scope of the appended claims.

What is claimed is:

1. A modular floor comprising:

a plurality of floor panels, each of which has a main body, a ridge formed at a side of the main body, an outer socket formed at an opposite side of the ridge relative to the ridge, a first lateral bottom portion formed below the ridge from the main body and having a flat side wall extending at an angle from a bottom surface of the main body and the ridge such that the first lateral bottom portion has a cross-section with a relatively wider upper part and a relatively narrower lower part, a second lateral bottom portion formed below the outer socket from the main body, a stepped portion formed at an external upper side of the second lateral bottom portion and abutted with a bottom of the outer socket, and a central bottom portion formed at a bottom side of the main body and protruding between the first and second lateral bottom portions; and a plurality of combination members, each of which has a base, a front retainer protruding upward from an outside edge of a lateral side of a top side of the base, a rear retainer protruding upward from an outside edge of an opposite lateral side of the top side of the base relative to the front retainer, a partition protruding upward from a midsection of the top side of the base, a fastening piece bending toward the rear retainer from the top side of the main body for engagement with the stepped portion, a first springy member mounted to the front retainer and facing a side of the front retainer, a second springy member mounted to the partition and facing a side of the front retainer, a first receiving portion formed between the front retainer and the partition and having a cross-section with a relatively wider part and a relatively narrower part for receiving the first lateral bottom portion, a second receiving portion formed between the rear retainer and the partition for receiving the second lateral bottom portion; and a third springy member mounted to the rear retainer and facing an opposite side of the partition relative to the first springy member, wherein a distance between the front retainer and the partition and a distance between the partition and the rear retainer on the top side of the main body are equal to one another, wherein the front retainer comprises a first inner socket to which the first springy member is mounted; the partition comprises a second inner socket to which the second springy member is mounted; the rear retainer comprises a third inner socket to which the third springy member is mounted; and wherein one of said combination members is engaged with two adjacent said floor panels in a way that the ridge of one of the two adjacent said floor panels is inserted into the outer socket of the other one of the two adjacent said floor panels such that a bottom of the ridge of the one of the two adjacent said floor panels presses on a top of the fastening piece of the one of said combination members to hold the one of said combination members and the two adjacent said floor panels tightly engaged in a way that a bottom surface of the base of the one of said combination members is substantially flush with bottom surfaces of the central bottom portions of the two adjacent said floor panels and the second springy member mounted to the partition directly abuts the flat side wall of the first lateral bottom portion.

2. The modular floor as claimed in claim 1, wherein the ridge of one of the two adjacent said floor panels is inserted into the outer socket of the other one of the two adjacent said floor panels in such a way that a gap is reserved between the ridge and the outer socket.

* * * * *